US005265584A

United States Patent [19]

Judson et al.

[11] Patent Number: 5,265,584

[45] Date of Patent: Nov. 30, 1993

[54] QUIVER

[75] Inventors: Linda D. Judson, Pontiac, Mich.; David A. Choma, Akron, Ohio; Bernard Horton-Corcoran, Peddieston, Scotland

[73] Assignee: Horton Manufacturing Company Inc., Stow, Ohio

[21] Appl. No.: 764,893

[22] Filed: Sep. 24, 1991

Related U.S. Application Data

[63] Continuation-in-part of Ser. No. 638,744, Jan. 8, 1991, abandoned.

[51] Int. Cl.[5] ..... F41B 5/06

[52] U.S. Cl. ..... 124/86; 124/25.7

[58] Field of Search ..... 124/23.1, 24.1, 25.5, 124/25.6, 25.7, 41.1, 44.5, 86, 88; 224/916

[56] References Cited

U.S. PATENT DOCUMENTS

| | | | |
|---|---|---|---|
| 2,464,068 | 3/1949 | Bear | 224/0.5 |
| 2,986,187 | 5/1961 | Gazzara | 224/916 X |
| 3,116,730 | 1/1964 | Tingley | 124/24.1 |
| 3,366,101 | 1/1968 | Saunders | 124/25.7 X |
| 4,073,328 | 2/1978 | Franklin | 124/25.7 X |
| 4,247,027 | 1/1981 | Tardiff | 124/25.7 X |
| 4,704,800 | 11/1987 | Stinson | 124/25.7 |
| 4,823,764 | 4/1989 | Knaack | 124/88 |

OTHER PUBLICATIONS

Browning, Morgan, Utah 84050 Archery, p. 29.

Precision Shooting Equipment, Inc., Tucson, Arizona, 1991 catalog, pp. 16 and 17.

Hoyt USA, Salt Lake City, Utah, 1990 Archery catalog, pp. 17 and 18.

E. W. Bateman & Co., P.O. Box 751, Fischer, Texas 78623, Hunting Accessories Catalog.

Attachment 1—Sketches of a Quiver (Admitted Prior Art).

*Primary Examiner*—Randolph A. Reese

*Assistant Examiner*—John Ricci

*Attorney, Agent, or Firm*—Renner, Kenner, Greive, Bobak, Taylor & Weber

[57] ABSTRACT

A quiver (10) for holding a plurality of arrows (15) includes a base member (11) and spaced arrow holding assemblies (12). Each arrow holding assembly (12) includes a plurality of independently pivotable arrow engaging tabs (23). An arrow (15) is removed from the quiver (10) by moving the arrow (15) to pivot the tabs. The arrow holding assemblies (12) may be adjusted along the longitudinal length of the base member (11). The adjustment may be by 0 use of a mounting flange (19) affixed to each arrow holding assembly (12), and having a groove (20) therein, corresponding to a tongue (21) in base member (11). According to the invention, each arrow holding assembly (12) may include a base plate (16) having a stop plate (18) upwardly extending therefrom, such that the stop plate (18) limits the pivotable movement of the pivotable tabs (23). The quiver (10) may also be provided with a mounting bracket (61) for mounting the quiver (10) to a bow (60). Arcuate slots (70) in one end of the bracket (61) allows pins (71) to move within the arcuate slots (70) to adjust the position of the quiver (10) relative to the bow (60).

25 Claims, 6 Drawing Sheets

QUIVER

RELATED APPLICATION

This application is a continuation-in-part of U.S. Pat. application Ser. No. 07/638,744, filed on Jan. 8, 1991.

TECHNICAL FIELD

This invention relates to a quiver for holding a plurality of arrows as used by an archer as well as to a bracket for mounting the quiver to a bow. More particularly, this invention relates to a quiver which provides for the convenient holding of a plurality of arrows and more specifically provides for the convenient removal thereof.

BACKGROUND ART

A quiver is a type of carrying case used by an archer to hold a supply of arrows therein. As such, it is important that the archer be able to quickly and easily insert arrows into the quiver, and more importantly, to quickly and easily remove the arrows, as needed, such as when encountering a quarry.

Most conventional quivers have an elongate stand with a protective arrowhead holding sheath on one end and a notched relatively hard plastic bar to hold the shaft of the arrows near the fletched end thereof. Usually the sheath is filled with some type of impregnable foam-like product and the arrows are held at one end by inserting the arrowhead in the foam and then vertically displacing the arrow shaft within a notch in the bar to hold the other end of the arrow.

Such quivers have several inherent problems. For example, arrows cannot be removed quickly because two motions are required by the user, that is, first the back of the arrow must be vertically lifted and then the arrow horizontally shifted to release the arrowhead from the foam-like insert in the sheath. Such movement not only takes time, which might be precious to the hunter when in sight of his quarry, but also, repeated insertions and removals of the arrowhead from the foam-like insert in the sheath deteriorates the insert requiring frequent replacement thereof. In addition, the snapping of the arrow out of the notches in the bar as well as the potential contact of the arrowhead with the sheath can cause a noise which would be detected by the quarry. Finally, the prior art quivers are limited in the number of arrows which can be carried by the hunter and if the hunter is one who perceives the need to carry a large number of arrows, he will be required to carry several quivers.

It is also known in the art to provide quivers with rotatable grips or tabs for holding an arrow in the quiver. By being rotatable, it is intended that the arrow be easily pulled from the grips in one motion. However, the quivers known to date have not proven to provide the quietness required by a hunter upon removal of the arrow. Furthermore, these quivers have been found to be difficult to load and unload with an arrow, that is, the rotatable nature of the arrow grips makes it difficult to insert an arrow into the quiver, because the grips tend to merely freely rotate on their axles rather than engage the arrow. This is even more of a problem when the quiver includes two laterally spaced and opposing grips for holding an arrow.

At least one quiver has been configured such that a plurality of grips are arranged in a staggered and back-to-back manner such that two sets of arrows are held in two parallel planes. To help prevent untoward rotation during loading and unloading of an arrow, each grip is configured such that a leading edge engages the grip to which it is backed against. This arrangement has proven unsatisfactory in that the rubber grips often do not have sufficient compression resistance to eliminate the over-rotation problem. Furthermore, the leading edges of the grips are worn away with repeated use, making the engagement with the other grips less positive and less effective.

Finally, it is often desirable that a quiver be mounted to a bow and devices which accomplish that result are known in the art. However, a disadvantage with the quiver mounts heretofore known is that the positioning of the arrows with respect to the bow is dependent upon the mounting bracket and the manner in which it attaches to the bow, and not the convenience of the archer.

DISCLOSURE OF THE INVENTION

It is thus a primary object of the present invention to provide a quiver from which arrows may be conveniently removed.

It is another object of the present invention to provide a quiver, as above, in which the arrows may be removed therefrom by a single motion of the user.

It is a further object of the present invention to provide a quiver, as above, in which no deleterious sound is created in removing an arrow therefrom.

It is yet another object of the present invention to provide a quiver, as above, which does not require a foam-like insert in the sheath thereof which normally must be frequently replaced.

It is an additional object of the present invention to provide a quiver, as above, which is not limited in the number of arrows received therein.

It is a still further object of the present invention to provide a quiver, as above, with aligned flexible, rotatable arrow holding tabs which are adjustably positioned on the quiver.

It is another object of the present invention to provide a quiver, as above, in which the rotatable movement of the tabs is limited for ease of inserting and removing the arrows.

It is a further object of the present invention to provide a quiver, as above, which is easily, conveniently and adjustably mountable on a bow.

These and other objects of the present invention, as well as the advantages over existing prior art forms, which will become apparent from the description to follow, are accomplished by the means hereinafter described and claimed.

In general, a quiver for holding a plurality of arrows and embodying the concepts of the present invention includes a base member and spaced arrow holding assemblies carried by the base member. Each of the arrow holding assemblies includes a plurality of independently pivotable tabs, and each tab is provided with means to engage an arrow, such that the arrow is removed from the tabs by moving the arrow to pivot the tabs. A means to adjust the position of each arrow holding assembly along the base member is also provided which includes a mounting flange carried by each arrow holding assembly, and a tongue and groove connection between each of the mounting flanges and the base member.

Also according to the present invention, each arrow holding assembly includes a base plate and a stop plate extending upwardly from the base plate, such that the stop plate limits the pivotable movement of the pivotable tabs.

In addition, according to the present invention, the quiver is provided with an apparatus for attaching it to a bow which includes a mounting bracket, first pin members affixing one end of the mounting bracket to the quiver, and second pin members affixing the other end of the bracket to the bow. At least one of the pin members is positioned within an arcuate slot in one end of the bracket, such that the quiver may be adjusted relative to the bow by moving the one of the pin members within the slot. Means are also provided to hold the quiver in the selected position.

A preferred exemplary quiver incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
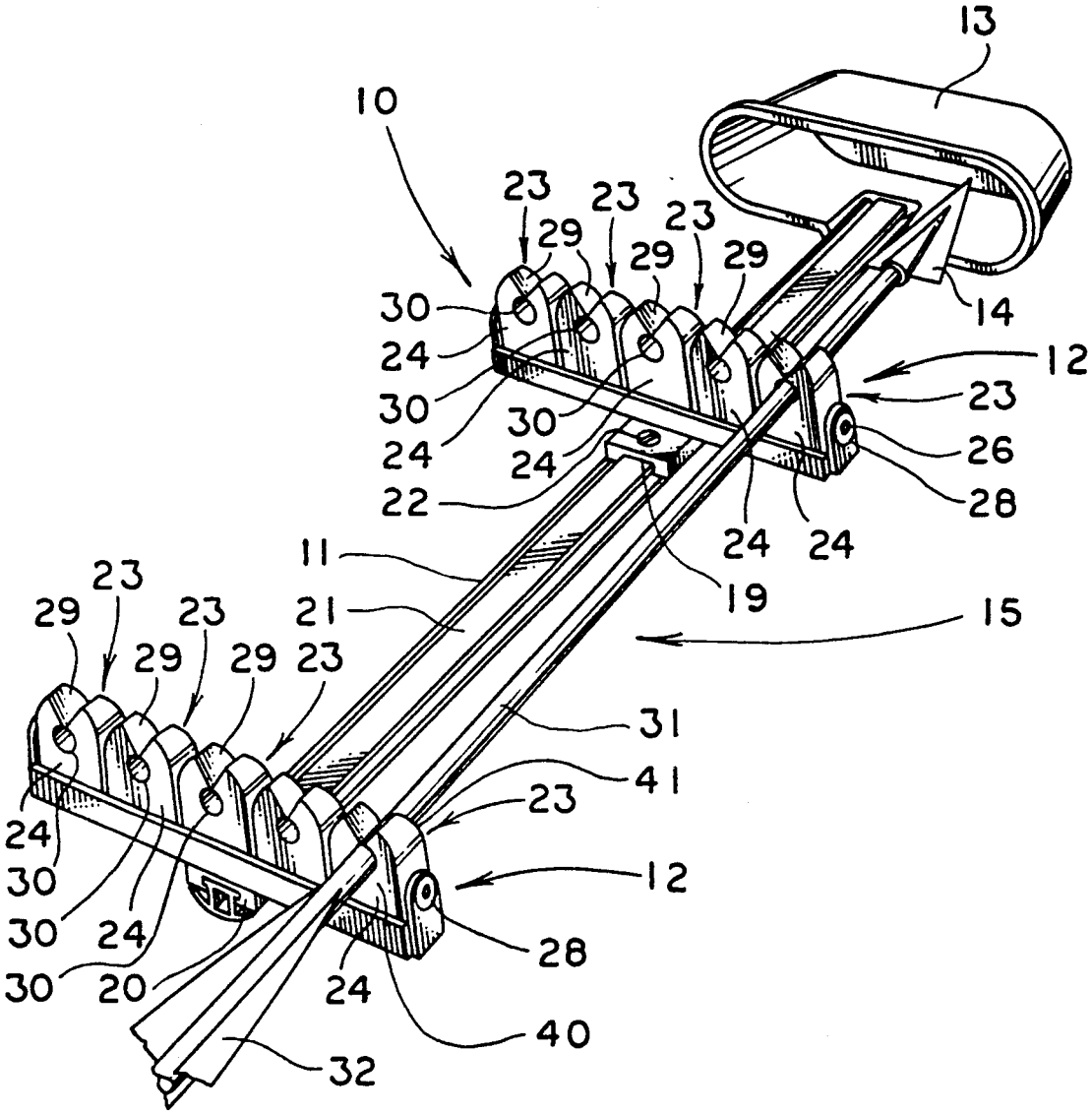
FIG. 1 is a perspective view of a quiver according concepts of the present invention.

A quiver according to the concepts of the present invention is indicated generally by the numeral 10 in FIG. 1 and is shown as including an elongate base support member 11 and at least two arrow holding assemblies indicated generally by the numeral 12. A sheath 13 is carried at one end of base support member 11. Since the only purpose of sheath 13 is to enclose the arrowhead 14 of an arrow, generally indicated by the numeral 15, and thus sheath 13 is not intended to engage arrowhead 14, it need not be provided with the foam-like insert as in the prior art.

Figure 2:
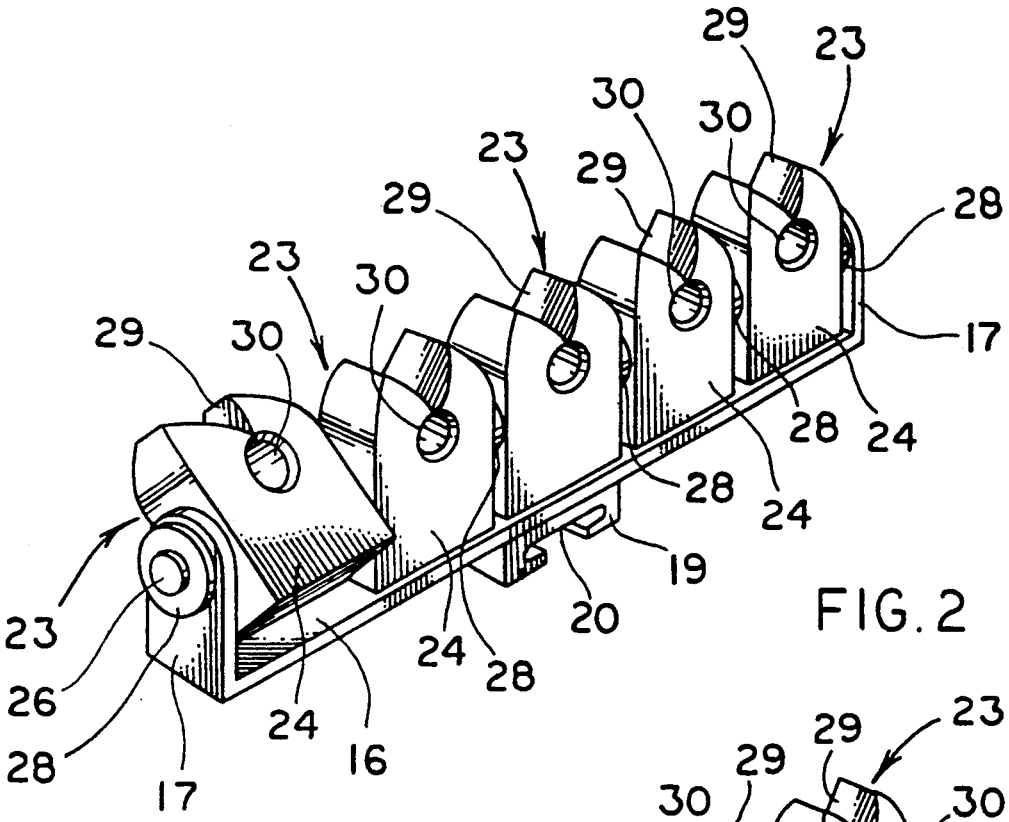
FIG. 2 is a perspective view of an arrow holding assembly of the quiver of FIG. 1 viewed from the other direction.
Figure 3:
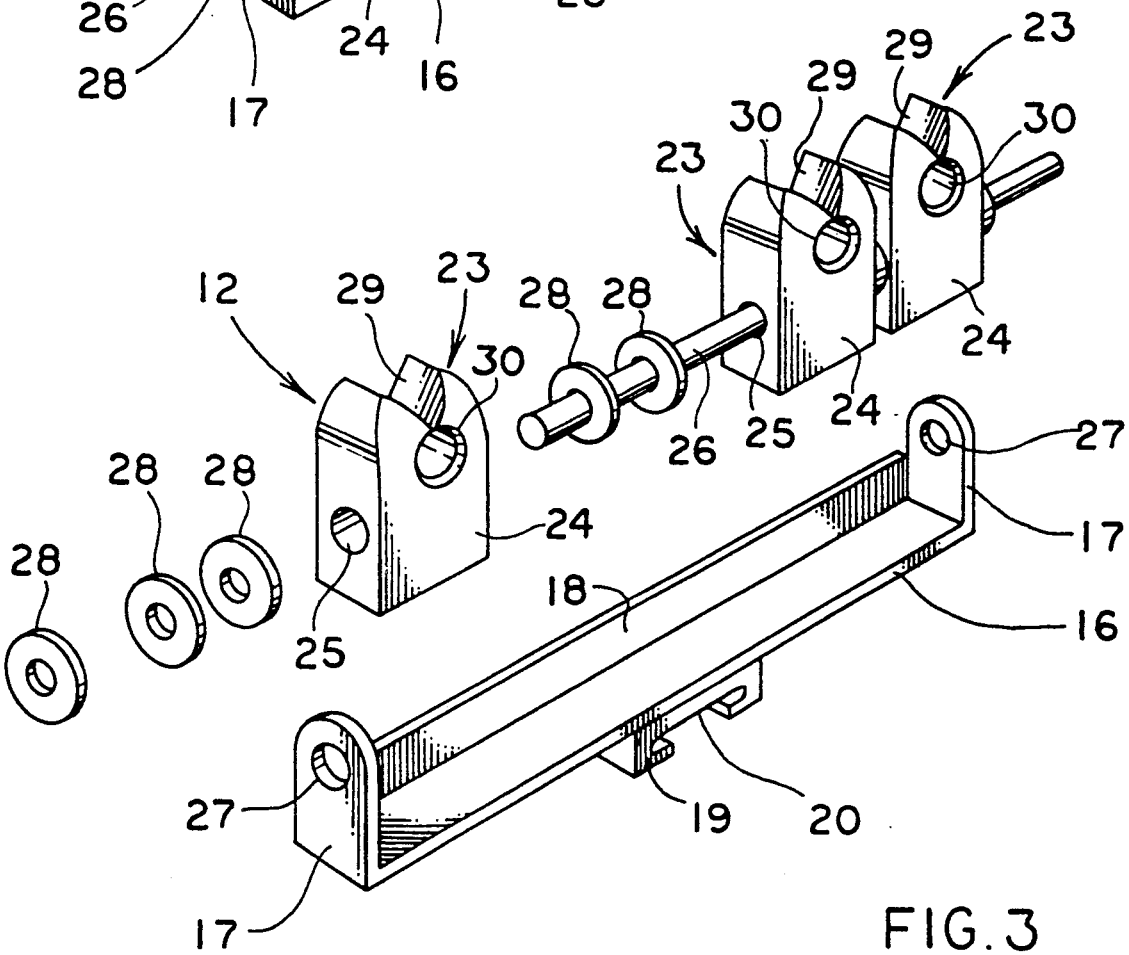
FIG. 3 is a partial exploded view of the arrow holding assembly of FIG. 2.
Figure 4:
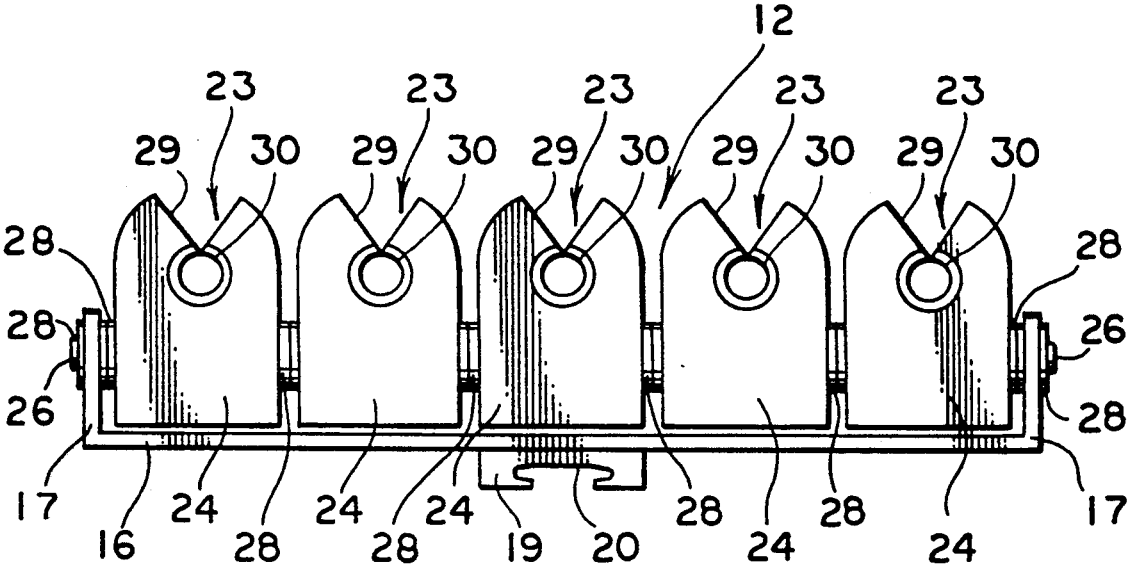
FIG. 4 is an elevational view of the arrow holding assembly of FIG. 2.

As best shown in FIG. 3, each arrow holding assembly 12 includes a generally horizontal base plate 16 having upstanding flanges 17 at the ends thereof and a rear stop plate 18 extending upwardly from base plate 16 and between flanges 17. As shown in FIG. 1 a mounting flange 19 extends outwardly from base plate 16 and is provided with a groove 20 to receive a tongue 21 which extends longitudinally along base support member 11. As such, arrow holding assemblies 12 may be positioned at any desired longitudinal position along base support member 11 and attached thereto as by a set screw 22 (FIG. 1) extending through flange 19. Moreover, as will hereinafter be described in more detail, such a fastening system allows arrow holding assemblies 12 to be totally removed from base support member 11 to be replaced by other similar assemblies. It should be noted that, as shown in FIG. 1, the flange 19 of the arrow holding assembly closest to sheath 13 (the arrow holding assembly shown in FIGS. 2 and 3) extends outwardly from the side of arrow holding assembly 12 having stop plate 18, whereas the flange 19 of the other arrow holding assembly extends from the other side thereof as shown in FIG. 1. However, it should be evident that flange 19 could extend from either side of either arrow holding assembly 12 without departing from the spirit of this invention.

Each arrow holding assembly 12 includes a plurality of arrow engaging segments or tabs generally indicated by the numeral 23. Tabs 23 are preferably made of a rubber, foam, or very soft plastic material and include a body portion 24 having an aperture 25 (FIG. 3) extending longitudinally therethrough. Apertures 25 of tabs 23 are adapted to receive a pivot rod 26 loosely therethrough such that tabs 23 may individually pivot on rod 26 in a manner to be hereinafter described. The ends of rod 26 are received in apertures 27 (FIG. 3) formed near the top of upstanding flanges 17 of base plate 16. Rod 26 may be retained in place by any suitable fastening mechanism known in the art such as a screw or cotter pin (not shown) positioned externally of each flange 17. Washer-like spacers 28 (preferably two) are provided between each adjacent tab 23, between the outermost tabs 23 and flanges 17, and can be provided, as well, on the external side of flanges 17 adjacent to the fastening mechanism. Each adjacent tab 23 is thus pivotal on rod 26 independently of the other tabs 23 as shown in FIG. 2.

As will hereinafter be described in more detail with reference to FIGS. 7 and 8, the top of each tab 23 is provided with a generally V-shaped notch 29, the lower apex of which opens into an aperture 30 extending laterally through body portion 24. As shown in FIG. 1, notch 29 and aperture 30 are designed to receive the shaft 31 of arrow 15. Because there are at least two arrow holding assemblies 12 longitudinally spaced along and affixed to base support member 11, arrow 15 is conveniently passed vertically downward through the notches 29 of aligned tabs 23 of each arrow holding assembly 12 and into the aligned apertures 30. While the spacing of arrow holding assemblies 12 can be adjusted, as previously described, it is preferable to have the rear assembly 12 positioned just forward of arrow fletching 32 and the front assembly 12 positioned closer to sheath 13 than to the rear assembly 12 to stably hold arrow 15 therein.

Figure 9:
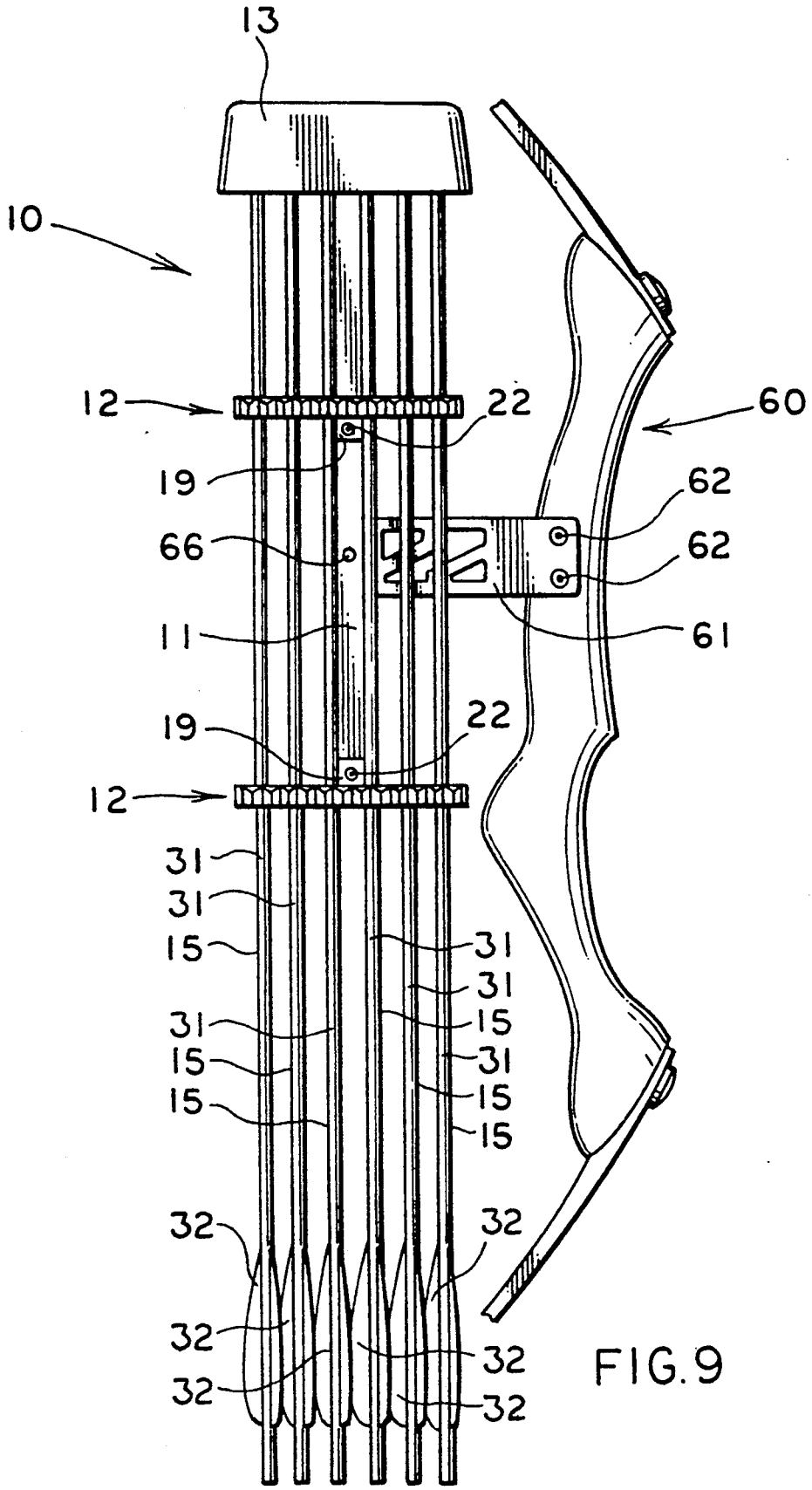
FIG. 9 is a side elevational, partially fragmented view of the quiver of FIG. 1 mounted upon a bow.

Any number of arrows 15 may thus be positioned in quiver 10 dependent on the number of tabs 23 in each arrow holding assembly 12. Thus, the quiver 10 shown in FIG. 1 is capable of holding up to five arrows but it should be appreciated that this invention is not limited to the number of arrows capable of being held by quiver 10. In fact, as previously described, the arrow holding assemblies 12 shown could be readily replaced with other arrow holding assemblies capable of carrying a different number of arrows by merely loosening set screw 22 and sliding assemblies 12 off of base support member 11 and replacing them with other assemblies, as desired. For example, FIG. 9 depicts a quiver 10 capable of holding six arrows 15.

Figure 5:
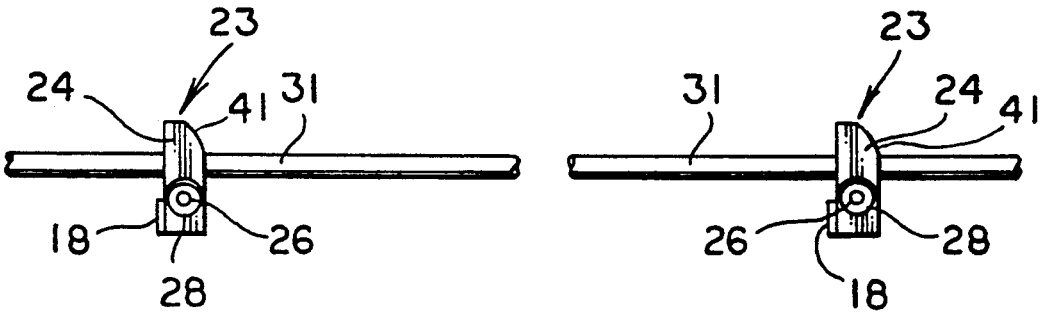
FIG. 5 is a somewhat schematic, fragmented, elevational view showing an arrow being held by segments of the arrow holding assemblies.
Figure 6:
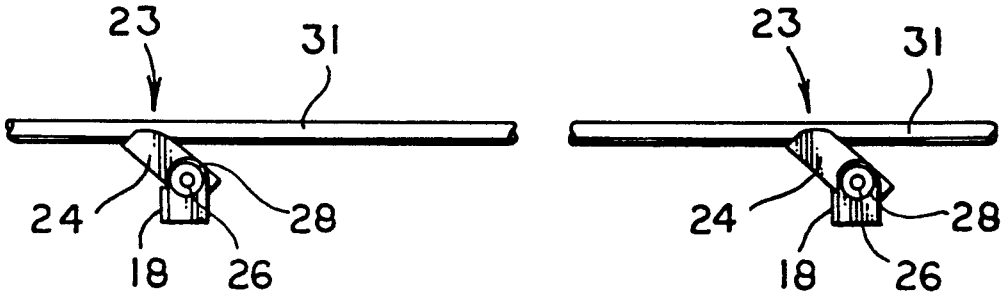
FIG. 6 is a somewhat schematic, fragmented, elevational view showing an arrow being removed from the segments of the arrow holding assemblies.

The unique manner in which an arrow 15 is removed from quiver 10 is best shown with reference to FIGS. 5 and 6. FIG. 5 shows the normal stored position of an arrow 15 in quiver 10 with its shaft 31 engaged by aligned tabs 23 of spaced arrow holding assemblies 12. To remove the arrow, the user needs to only perform the single motion of pulling the arrow generally horizontally, to the left as shown in FIG. 5. Such motion rotates the individual tabs 23 which are holding shaft 31 counterclockwise about rod 26, as shown in FIG. 6, until such time that shaft 31 is released from apertures 30 and passes into notches 29 whereby it is free of the grasp of assemblies 12. This rearward rotation, away from sheath 13, is limited by stop plate 18, the top of which engages body portion 24 of tabs 23. It should also be noted that potential forward rotation of tabs 23, which might occur when an arrow is being positioned in quiver 10, is also prevented by stop plate 18 because the bottom of body portion 24 of tabs 23 would immediately engage stop plate 18. Finally, it should be appreciated that because each tab 23 is spaced from its adjacent tab 23 by washers 28, the other tabs 23 in each assembly 12, which might also be holding arrows at the time, will not rotate on rod 26.

Figure 7:
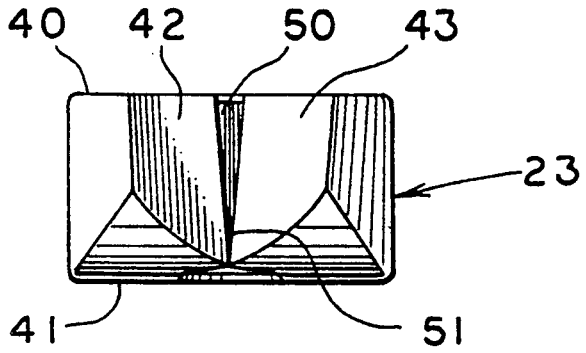
FIG. 7 is a top plan view of one embodiment of a tab used in the arrow holding assembly of FIG. 1.
Figure 8:
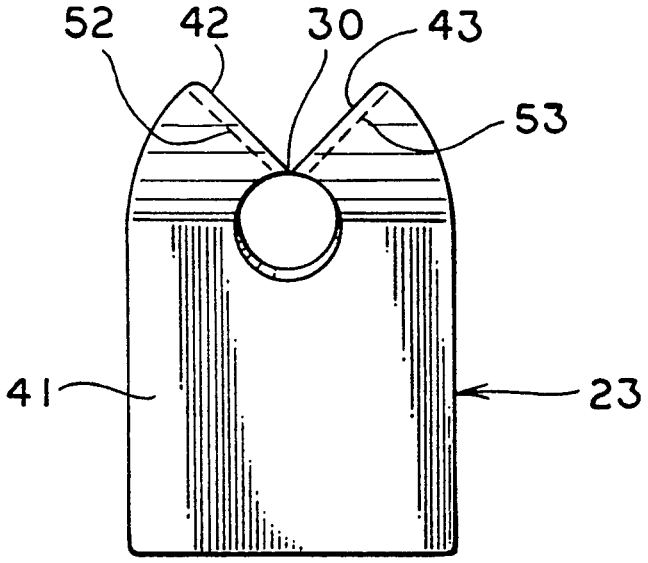
FIG. 8 is a front elevational view of the tab of FIG. 7.

The specific and preferred configuration of tabs 23 is best shown in FIGS. 7 and 8. There, tabs 23 are identified as having a first side 40 and a second side 41. For reference, second side 41 is the side positioned between first side 40 and sheath 13, such that second side 41 is facing sheath 13 (FIG. 1). V-shaped notches 29 are preferably formed by a first tapered notch sidewall 42 and a second tapered notch sidewall 43. As stated hereinabove, it is preferred that each V-shaped notch 29 have a lower apex which opens into aperture 30. A laterally oriented V-shaped notch 50 is preferably cut into the bottom of notch sidewalls 42 and 43 where those sidewalls communicate with aperture 30. V-shaped notch 50 therefore has its apex 51 formed by the intersection or closest point of proximity (either being equally within the scope of the invention) between first notch sidewall 42 and second notch sidewall 43.

V-shaped notch 50 is created by inwardly tapering first and second notch sidewalls 42 and 43 from first side 40 to second side 41 of tab 23. As shown in FIG. 8, first notch sidewall 42 intersects first side 40 of tab 23 at phantom line 52. Similarly, second notch sidewall 43 intersects first side 40 at phantom line 53. Preferably the angle of V-shaped notch 50, formed by the intersection of the planes of first and second notch sidewalls 42 and 43 at or proximate to apex 51, is approximately 3 degrees, although this is not critical to the invention.

By forming V-shaped notch 50 by tapering notch sidewalls 42 and 43, tabs 23 are encouraged to pivot toward sheath 13 when arrow shaft 31 is being inserted into quiver 10. When arrow 15 is being placed into quiver 10, a force is exerted onto tab 23 in a direction toward apex 51, and hence, toward sheath 13. Tab 23 is prevented from pivoting toward sheath 13 by engagement with stop plate 18, as discussed hereinabove. Therefore, the force urging tab 23 toward sheath 13 ensures a decreased tendency for tab 23 to rotate or pivot during insertion of arrow 15. This makes insertion smoother and easier for the user.

The manner in which quiver 10 may be mounted upon a bow, generally indicated by the numeral 60, is shown in FIG. 9. Bow 60 is only partially shown for ease of illustration, but it may be a long bow, compound bow, crossbow or the like. It is preferred that quiver 10 be mounted on an adjustable mounting mechanism, such that the user may position quiver 10 so that insertion and removal of arrows 15 is as convenient as possible. For example, one user may find it easier to insert and remove arrows 15 from quiver 10 when arrows 15 are held parallel to the bowstring (not shown) of bow 60. Another user may prefer to have arrow 15 held at some angle to the bowstring. When thus positioned according to the choice of the user, manipulating quiver 10 will be easier, and less noise will be made when inserting and removing arrows 15.

Figure 11:
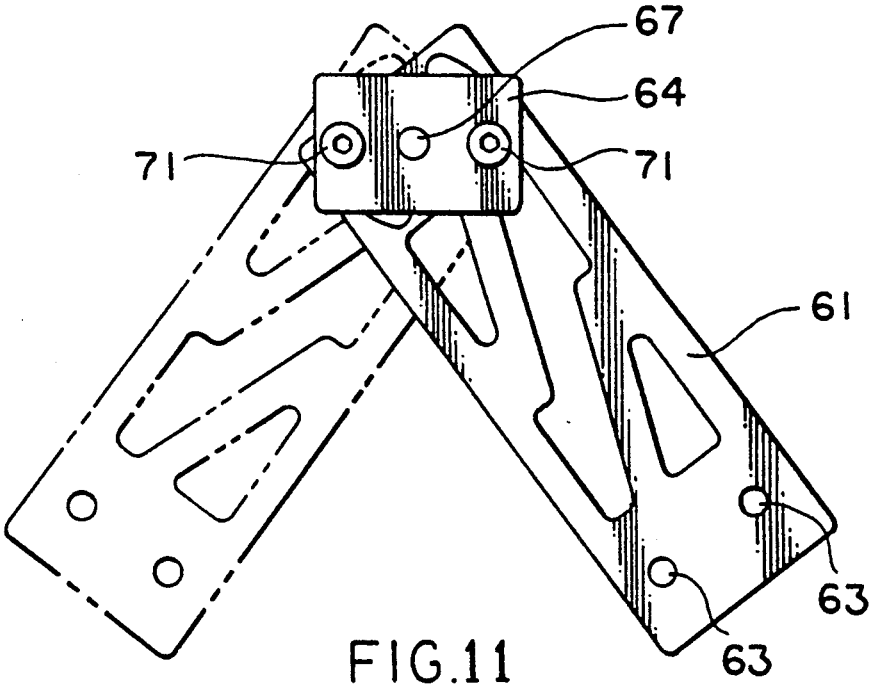
FIG. 11 is a bottom view of a portion of the mounting mechanism of FIG. 10 showing a mounting bracket in one position in solid lines, and an adjusted position in phantom lines.
Figure 10:
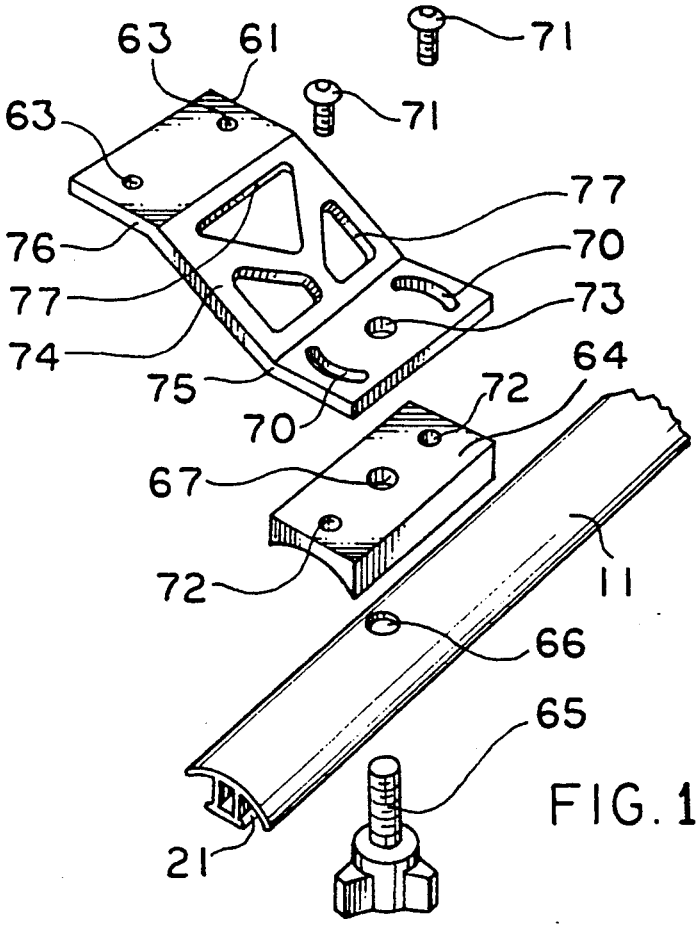
FIG. 10 is an exploded, partially fragmented view of a mechanism to mount the quiver of FIG. 1 to a bow.

One preferred mechanism for adjustably mounting quiver 10 onto bow 60 is shown by way of example in FIGS. 9–11. One end of a bracket 61 is secured to bow 60 and the other end of bracket 61 is attached to base support member 11 of quiver 10. Bracket 61 may be secured to bow 60 and quiver 10 by any means known. Preferably, bracket 61 is secured to bow 60 by pins or screws 62 (FIG. 9) inserted through screw holes 63 (FIG. 10).

Bracket 61 is secured to base support member 11 by use of attachment block 64, which is itself affixed to base support member 11 such as by thumbscrew 65 inserted through an aperture 66 in base support member 11 and into an aperture 67 in attachment block 64. By employing thumbscrew 65, bracket 61 may be readily dismounted from bow 60 if desired.

Bracket 61 is configured to have at least one and preferably two arcuate slots 70 (FIG. 10) in the end opposite the end affixed to bow 60. Screws or pins 71 are inserted through slots 70 and into corresponding screw holes 72 in attachment block 64. Thumbscrew 65 may also extend into an aperture 73 in bracket 61. Thus, bracket 61 is free to rotate about thumbscrew 65, and screws or pins 71 are allowed to travel within slots 70. As shown in FIG. 11, a bracket 61 may thus be placed in one position shown by solid lines or another shown by phantom lines, or some other position therebetween as desired by the user. Because quiver 10 is affixed to bracket 61, it also will change its position relative to bow 60 as bracket 61 is adjusted. Arrows 15 may thus be held in any position relative to bow 60. It will be appreciated that arcuate slots 70 may be configured in either or both ends of bracket 61, and that pins or screws 62 may be placed within an arcuate slot for adjusting quiver 10 at bow 60 rather than at quiver 10.

While bracket 61 is shown as being relatively flat in FIGS. 9 and 11, it is depicted in FIG. 10 as having an angled middle portion 74, that is, having a middle portion 74 being oriented at an angle 75 to the portion thereof attached to quiver 10 and being oriented at an angle 76 to the portion thereof attached to bow 60. Such a configuration would allow quiver 10 to be mounted some distance away from bow 60, as might be desirable to avoid interference with an archer's hand or site equipment mounted on bow 60 (not shown). Middle portion 74 of bracket 61 may also be provided with cutout areas, as at 77, to reduce weight and to provide a decorative function.

It should thus be appreciated that a quiver constructed according to the concepts of the present invention, as described herein, substantially improves the art and otherwise accomplishes the objects of the invention.

We claim:

1. A quiver for holding a plurality of arrows comprising a base member; spaced arrow holding assemblies carried by said base member, each said arrow holding assembly including a base plate, a stop plate extending upwardly from said base plate, and a plurality of independently pivotable tabs; each of said tabs being provided with means to engage an arrow such that the arrow is removed from said tabs by moving the arrow to pivot said tabs; and means to adjust the position of each arrow holding assembly along said base member; such that pivoting of said tabs is limited by engagement of said tabs with said stop plate.

2. A quiver according to claim 1 wherein said means to engage an arrow includes an aperture in each tab, said aperture in each tab opening into a notch at the top of each tab.

3. A quiver according to claim 1 wherein the tabs of one said arrow holding assembly are aligned with the tabs of another said arrow holding assembly.

4. A quiver according to claim 1 wherein each said arrow holding assembly includes, flanges extending upwardly from near the ends of said base plate, and a rod carried between said flanges, said tabs being pivotable on said rod.

5. A quiver according to claim 4 wherein each said arrow holding assembly further includes means to space said tabs on said rod.

6. A quiver according to claim 1 wherein each said arrow holding assembly includes a mounting flange, said means to adjust including a tongue and groove connection between said mounting flange and said base member.

7. A quiver according to claim 6 wherein said means to adjust further includes means to hold said arrow holding assemblies at the desired position along said base member.

8. A quiver according to claim 1 further comprising an arrowhead sheath positioned near one end of said base member.

9. A quiver according to claim 1 wherein said tabs are constructed of a rubber material.

10. A quiver for holding a plurality of arrows comprising a longitudinally extending base member, a first arrow holding assembly carried by said base member, a plurality of individually pivotable arrow holding tabs carried by said first arrow holding assembly, a second arrow holding assembly carried by said base member and longitudinally spaced from said first arrow holding assembly, a plurality of individually pivotable arrow holding tabs carried by said second arrow holding assembly, said arrow holding tabs of said first arrow holding assembly being aligned with said arrow holding tabs of said second arrow holding assembly such that an arrow is removed from the aligned arrow holding tabs by moving the arrow to pivot the aligned tabs, a mounting flange carried by each of said first and second arrow holding assemblies, and means to adjust the position of said first and second arrow holding assemblies longitudinally along said base member, said means to adjust including a tongue and groove connection between each said mounting flange and said base member.

11. A quiver according to claim 10 wherein said tabs include an aperture extending laterally therethrough and in the longitudinal direction of said base member, and a notch at the top of each of said tabs, said apertures opening into said notches such that an arrow positioned in a said notch will be received in a said aperture.

12. A quiver according to claim 10 wherein each said arrow holding assembly includes a base plate, flanges extending upwardly from near the ends of said base plate, and a rod carried between said flanges, said tabs being pivotable on said rod.

13. A quiver according to claim 12 wherein each said arrow holding assembly further includes means to space said tabs on said rod.

14. A quiver according to claim 12 wherein each said arrow holding assembly further includes means to limit the pivotal movement of said tabs.

15. A quiver according to claim 10 wherein said means to adjust includes means to hold said first and second arrow holding assemblies at the desired longitudinal position along said base member.

16. A quiver for holding a plurality of arrows comprising a base member, and spaced arrow holding assemblies carried by said base member, each said arrow holding assembly including a plurality of independently pivotable tabs, each of said tabs being provided with means to engage an arrow such that the arrow is removed from said tabs by moving the arrow to pivot said tabs, each said arrow holding assembly including a base plate and a stop plate extending upwardly from said base plate, such that said stop plate limits the pivotal movement of said pivotable tabs.

17. A quiver according to claim 16 wherein said means to engage an arrow includes an aperture in each tab, said aperture in each tab opening into a notch at the top of each tab.

18. A quiver according to claim 16, wherein each said arrow holding assembly further includes flanges extending upwardly from near the ends of said base plate, and a rod carried between said flanges, said tabs being pivotable on said rod.

19. A quiver according to claim 16, wherein said means to engage an arrow of each said tab includes a V-shaped notch having an apex opening into an aperture.

20. A quiver according to claim 19 wherein said V-shaped notch is formed from first and second notch sidewalls.

21. A quiver according to claim 20 wherein said first and second notch sidewalls are tapered such that the planes of said first and second sidewalls intersect to form an angle.

22. A quiver according to claim 21 wherein said angle is approximately 3 degrees.

23. A quiver for holding a plurality of arrows and mountable upon a bow, comprising a base member, and spaced arrow holding assemblies carried by said base member, each said arrow holding assembly including a plurality of independently pivotable tabs, each of said tabs being provided with means to engage an arrow such that the arrow is removed from said tabs by moving the arrow to pivot said tabs, a mounting bracket, first pin means affixing one end of said mounting bracket to the quiver, second pin means affixing the other end of said mounting bracket to the bow, at least one of said pin means being positioned within an arcuate slot in one end of said bracket, such that the quiver may be adjusted relative to the bow by moving said one said pin means within said slot, and means to hold the quiver in the selected position.

24. A quiver according to claim 23 further comprising an attachment block affixed to said base support member.

25. A quiver according to claim 23 wherein said means to hold the quiver in the selected position is a thumbscrew positioned through an aperture in said base support member and an aperture in said attachment block.

* * * * *